US005366108A

United States Patent [19]

Darling

[11] Patent Number: 5,366,108

[45] Date of Patent: Nov. 22, 1994

[54] TOY WATER GUN SYSTEM

[76] Inventor: Michael Darling, P.O. Box 8054, Long Beach, Calif. 90808

[21] Appl. No.: 151,927

[22] Filed: Nov. 15, 1993

Related U.S. Application Data

[63] Continuation-in-part of Ser. No. 932,699, Aug. 20, 1992, abandoned.

[51] Int. Cl.[5] ..... B67B 7/00

[52] U.S. Cl. ..... 222/1; 222/79; 222/175; 222/386.5; 446/473

[58] Field of Search ..... 222/79, 95, 105, 175, 222/325, 386.5, 389, 401, 464, 1; 446/473; 239/99

[56] References Cited

U.S. PATENT DOCUMENTS

| | | | |
|---|---|---|---|
| D. 318,309 | 7/1991 | D'Andrade . | |
| 3,318,482 | 5/1965 | Voice . | |
| 3,578,789 | 5/1971 | Ferri | 222/79 |
| 4,214,674 | 7/1980 | Jones et al. . | |
| 4,239,129 | 12/1980 | Esposito . | |
| 4,257,460 | 3/1981 | Parnay et al. . | |
| 4,273,272 | 6/1981 | Blanc | 222/464 |
| 4,735,239 | 4/1988 | Salmon et al. . | |
| 4,782,982 | 11/1988 | Ellison . | |
| 4,854,480 | 8/1989 | Shindo . | |
| 4,875,508 | 10/1989 | Burke, II et al. | 222/95 X |
| 4,930,664 | 6/1990 | Ellison . | |
| 5,074,437 | 12/1991 | D'Andrade et al. . | |

*Primary Examiner*—Gregory L. Huson
*Attorney, Agent, or Firm*—Howard A. Kenyon

[57] ABSTRACT

A toy water gun that can release a directed stream of water from a pressurized receptacle is disclosed. The toy water gun is connected to the pressurized receptacle by a flexible hose and a pull on the trigger releases a directed stream of water. In one embodiment, the receptacle has a one way valve attached thereto that allows pressurized water to only enter the receptacle. A flexible tube is attached to the one-way valve on one end with the flexible tubing terminating with a hose fitting on the other end attachable to a hose bib. The pressurized water is supplied by a water system such as a municipal water supply. Another embodiment uses a bladder inside a receptacle containing trapped air that is connected directly by flexible tubing to a shut off valve which is further connected by flexible tubing to a hose bib that supplies pressurized water. When the receptacle is fully charged and the pressure in the receptable is equal to the pressure of the municipal water supply, the shut off valve is turned off and the flexible tubing to the hose bib is disconnected at the shut off valve. A flexible tube is them connected from the shut off valve to the toy water gun. The shut off valve is them turned on and the toy water gun is ready for use.

18 Claims, 2 Drawing Sheets

TOY WATER GUN SYSTEM

CROSS REFERENCE TO RELATED APPLICATION

The present application is a continuation-In-Part of my co-pending application, Ser. No. 07/932,699 filed Aug. 20, 1992 for Toy Water Gun System now abandoned.

BACKGROUND OF THE INVENTION

1. Field of the Invention

This invention relates to a toy water gun system with a separate pressurized receptacle and more specifically to a pressurized receptacle that is charged by a municipal water supply.

2. Description of the Prior Art

Water guns are very popular as a child's toy and have been for some time. There are many different styles of water guns that have been developed to profit from the toy's popularity. The most popular forms of water guns are activated by pumping action manually through the trigger, however, this type of toy is limited in the distance the water travels and the duration of the pumping action. Another type of water gun utilizes the difference in pressure from the water in the gun and the pressure of the ambient air. Since the water in the gun is higher than the ambient air, when the water in the gun is given an avenue of escape, the water will stream out under pressure.

An example of this type of gun is given by U.S. Pat. Nos. 4,854,480, 4,735,239, and 4,257,460. All of these patents show water guns that use an elastic bladder to pressurize the water. The bladders are filled with water and the bladders respond by elastically deforming. The water under pressure by the deforming bladder is released through the gun by a trigger mechanism through a small orifice which provides a stream. Another type of pressure activated water gun uses air pressure to force water through a small orifice. This type is reflected by U.S. Pat. Nos. 4,214,674 and 5,074,437. These guns use a pumping device that pumps air into an enclosed reservoir with the air pressure pushing down on the water. One such device is U.S. Pat. No. 5,074,437 to D'Andrade et al has enjoyed commercial success and is know in the toy stores as the "Super Soaker". The structure in U.S. Pat. No. 5,074,437 is not designed to withstand a pressure of 100 pounds per square inch (psi) as in the present invention. All of the present toy guns use either water pressure to elastically deform a bladder or air pressure pushing the water out since the air pressure inside the reservoir is greater than ambient air. What is needed is a device that uses water from a source of pressurized water to charge a receptacle that contains trapped air. One way of introducing a source of pressurized water is by using the pressure from a public utility system like a municipal water supply. The air inside the receptacle is compressible while the water is incompressible. There are no known water pistol systems that use pressurized water from a source like a municipal water supply to charge the toy water gun system.

SUMMARY OF THE INVENTION

It is the object of the present invention to use pressurized water supplied to charge a receptacle of a toy water gun system.

It is another object of the present invention to pressurize a receptacle of a toy water gun system containing both water and air by a municipal water supply.

It is yet another object of the present invention to pressurize a receptacle using pressurized water supplied by a municipal water supply wherein the water is contained in a bladder and the receptacle of the toy water gun system contains both air and water.

Briefly, in accordance with the present invention, there is provided a receptacle for a toy water gun system designed to withstand at least 100 psi pressure. In one embodiment the water is in the bottom of the receptacle while the air is at the top. When the water is connected by direct means to a hose bib with a shutoff valve and the shutoff value is turned on, sufficient water will flow in the receptacle until the water and the air in the upper part of the receptacle is at the water pressure of a municipal water supply which is approximately 80 psi. A one way value into the receptacle will prevent the water in the receptacle from escaping when the water pressure source is disconnected. A flexible tube leading from the receptacle to a toy water gun containing a shutoff valve connected to a toy water gun trigger allows the pressurized water in the receptacle to be directed in a stream emanating from the toy water gun. The toy water gun system is then ready to be used by an operator.

Another embodiment that uses a bladder inside a receptacle containing trapped air is directly connected to the water pressure of a municipal water supply supplied by flexible tube having a connector attached to a hose bib on one end. The flexible tube is attached to an on/off valve on the other end. When the receptacle is charged and the pressure in the receptacle is equal to the pressure of the municipal water supply, the valve is turn off, the flexible tube to the hose bib is disconnected and a flexible tube coming from the toy water gun is connected to the on/off valve. When the on/off valve is opened, the toy water gun is them ready to be used by an operator.

These and other objects, features and advantages of the present invention will become more readily apparent upon detailed consideration of the following description of a preferred embodiment with reference to the accompanying drawings.

DETAILED DESCRIPTION OF THE INVENTION

Figure 1:
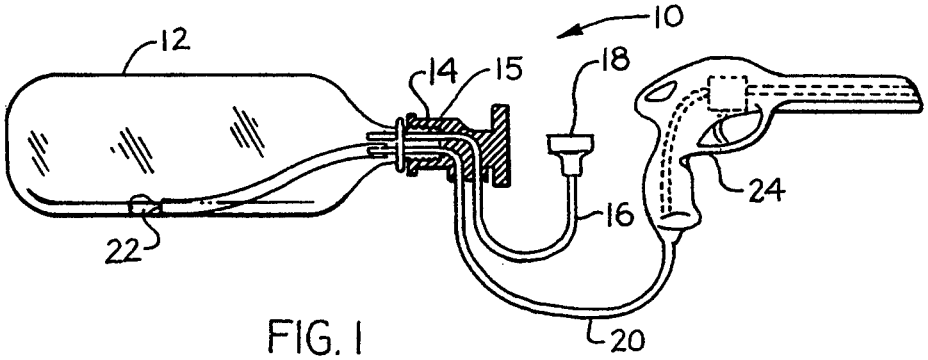
FIG. 1 shows a receptacle, and a toy water gun with a flexible tube attached to the toy water gun on one end with the other end attached to the receptacle. A flexible tube is also shown attached to the receptacle on one end with a hose fitting on the other end.

Referring now to FIG. 1 there is a toy water gun system generally shown as 10, having a receptacle shown as 12. Receptacle 12 is shown as a cylindrical shape being rounded on one end with a circular neck 15 on the other end. Receptacle 12 in this shape is the most efficient design to withstand a pressure of at least 100 psi. Attached to the circular neck 15 of receptacle 12 is a fitting 14 which is preferably threaded to circular neck 15 with an internal seal (not shown) between the fitting 14 and circular neck 15. A flexible tube 16 is attached to the fitting 14 on one end and to an internal threaded hose fitting 18 on the other end which will attach to a common hose bib (not shown). Flexible tube 16 feeds into a spring biased one-way valve incorporated into fitting 14. Hose fitting 18 having an internal seal (not shown) rotates and screws on to a hose bib found around almost every residence that has a municipal water supply. Flexible tube 20 passes through fitting 14 and terminates on one end inside receptacle 12 with a weight 22 attached thereto. Since the receptacle 12 is round, the weighted end 22 will insure the that the flexible tube 20 will always stay on the bottom of receptacle 12. An alternate means of securing flexible tube 20 is a clip on the inside of the bottom of the receptacle 12. The other end of flexible tube 20 extends into toy water gun 24. Toy water gun 24 has a spring biased trigger mechanism (not shown) that allows the water to flow from toy water gun 24 in a directed stream when the trigger mechanism is activated and shut off the water flow when the trigger mechanism is released.

Figure 2:
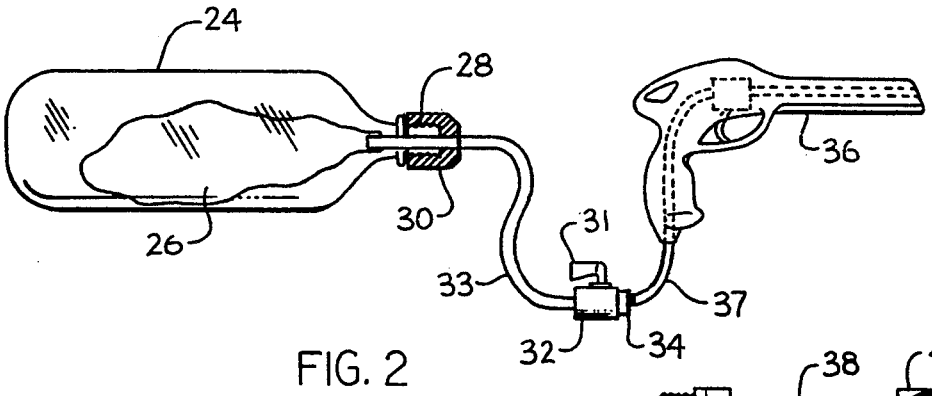
FIG. 2 shows a receptacle, a bladder inside the receptacle, a toy water gun and a on/off valve between the receptacle and the toy water gun.

FIG. 2 shows a receptacle 24 which is the same shape as receptacle 12 in FIG. 1. Receptable 24 is also designed to withstand a pressure of at least 100 psi Internal to receptacle 24 is a bladder 26. Attached to one end of receptacle 24 is a fitting 30 which is preferably threaded to receptacle 24 with a seal (not shown) between the fitting 30 and receptacle neck 28. Passing through fitting 30 is a flexible tube 33 which has the bladder attached on one end and on the other end terminates with a fitting 32 containing an on/off valve 31. Fitting 32 contains internal threads that mate with external threads on fitting 34. Attached to fitting 34 in FIG. 2 is a flexible tube 37 that terminates inside the toy water gun 36. Toy water gun 36 also has a spring biased trigger mechanism (not shown) that allows the water to flow from toy water gun 36 in a directed stream when the trigger mechanism is activated and shut off the water flow when the trigger mechanism is released.

Figure 3:
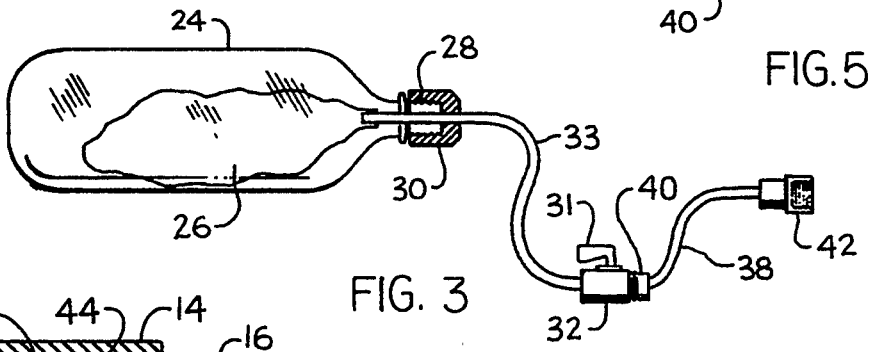
FIG. 3 shows the configuration of FIG. 2 with a flexible tube from the shutoff valve to a hose connection which fits on a hose bib.

FIG. 3 shows the same configuration as FIG. 2 with a flexible tube 38 having a rotatable connector 42 that will fit on a hose bib which allows bladder 26 to be filled with pressurized water when the on/off valve 31 is turned on.

Figure 5:
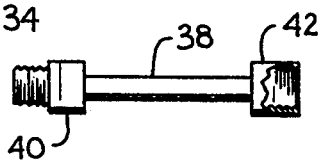
FIG. 5 shows a flexible tube with an external threaded fitting on one end to fit in a shut off valve and an internal threaded fitting on the other end to fit on a hose bib.

The flexible tube 38 is also shown in FIG. 5. The flexible tube 38 has external threads 40 on one end to fit into fitting 32 and internal threads 42 that will fit a hose bib on the other end. The internal threads 42 allow the bladder to be charged by a municipal water supply when connected to a hose bib with the on/off valve 31 turned on and the hose bib valve also turned on releasing the water pressure from a municipal water supply. It has been determined that the pressure of a municipal water supply ranges from 70 to 90 psi.

Figure 4:
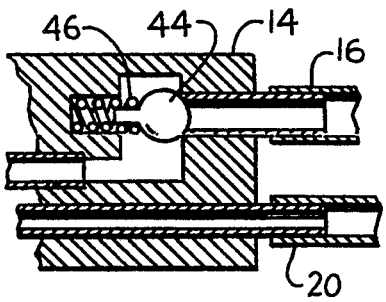
FIG. 4 shows a cut away of the one way valve used on the configuration of FIG. 1.

FIG. 4 shows a cut away of the internal spring biased one-way valve in fitting 14. This allows the water to flow only into receptacle 12. In FIG. 4, ball 44 is pushed off its seat against spring 46 when the water is flowing and when the pressure ceases, ball 44 seats itself urged by spring 46 and the flow is stopped.

Figure 6:
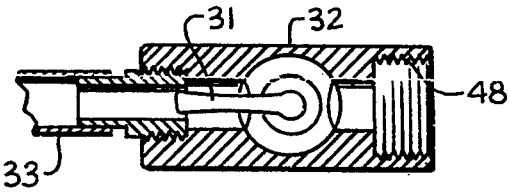
FIG. 6 is a top partial cut away view of the on/off valve shown in FIGS. 2 and 3.

FIG. 6 show fitting 32 with on/off valve 31 in its open position. The internal thread 48 in fitting 32 can also be seen in this view.

Figure 7:
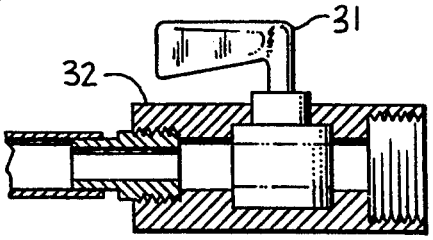
FIG. 7 is a side partial cut away view of the on/off valve shown in FIGS. 2 and 3.

FIG. 7 is the same fitting 32 as in FIG. 6 only showing a side cut-away view. In this view the on/off valve 31 is in the open position.

Figure 8:
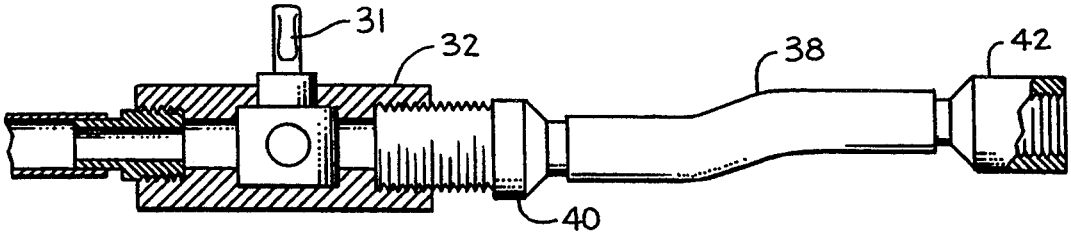
FIG. 8 is a side partial cut away view of the on/off valve shown in FIGS. 2 and 3 with the flexible tube shown in FIG. 5 in place.

FIG. 8 shows the fitting 32 with the on/off valve 31 in a closed position. The flexible tube 38 with external threads 40 and internal threads 42 is also shown.

Figure 9:
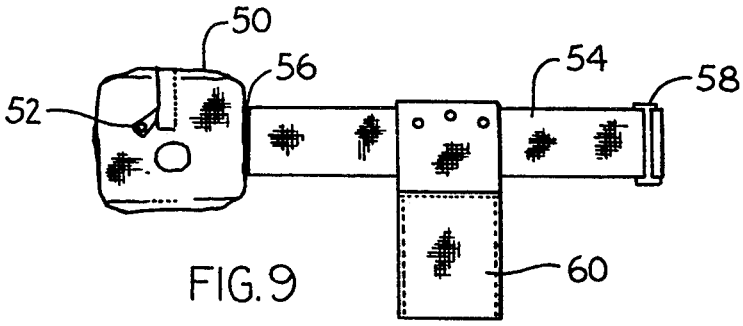
FIG. 9 shows a flexible belt with a flexible bag attached to the rear and a toy water gun holster attached to the belt.

Turning now to FIG. 9 there is seen a flexible bag 50 preferably made from cloth that holds either receptacle 12 or 24. A fastener 52 is located on the top of the flexible bag which is either a zipper type or Velcro®. A flexible adjustable belt 54 worn by an operator is also seen in FIG. 9. The flexible bag 50 is attached to the flexible adjustable belt 54 by a fastener 56. Adjustable means of flexible adjustable belt 54 which is a buckle type in the preferred embodiment is shown as 58 in FIG. 9. Also seen in this view is a holster 60 fastened to flexible adjustable belt 54. Holster 60 is permanently fastened to flexible belt by either sewing or rivets.

Figure 10:
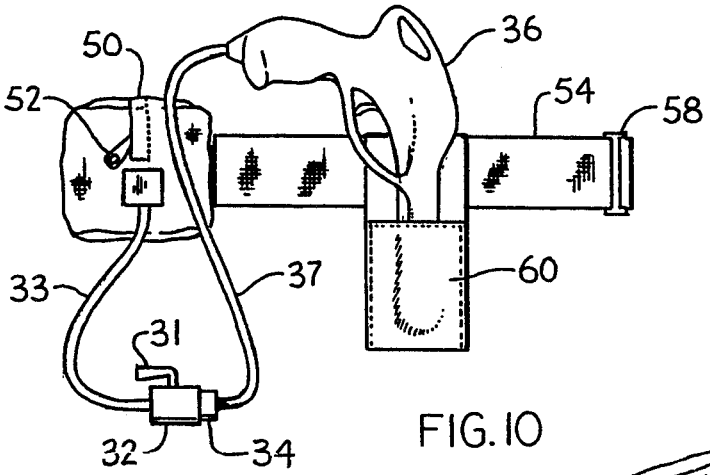
FIG. 10 is a side view of FIG. 9 with the flexible tube running from the receptacle inside the bag through the on/off valve to the toy water gun.

FIG. 10 shows the configuration as in FIG. 2 where the receptacle is placed in the flexible bag 50 and the toy water gun 36 is placed in holster 60. Also shown in this figure is flexible tube 33 fitting 32, shut-off valve 31, fitting 34 and flexible tubing 37 attached to the toy water gun 36.

Figure 11:
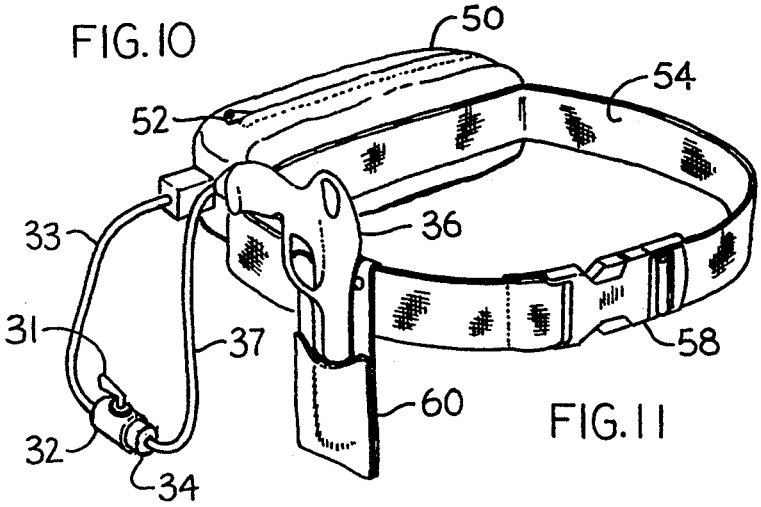
FIG. 11 is a perspective view of the configuration of FIG. 10.

FIG. 11 gives a perspective view of the configuration described in FIG. 10.

The operation of the toy water gun system described herein is very simple. In one embodiment as shown in FIG. 1, ambient air is trapped inside the bottle prior to being charged. Hose fitting 18 is fitted on a hose bib (not shown) supplying pressurized water provided by a municipal water supply. The pressurized water is allowed to flow past a check valve shown in FIG. 4 into receptacle 12 which pressurizes the trapped air. When the pressure in the receptacle 12 equals the pressure of the municipal water supply (70 to 90 psi), flow will stop. Hose fitting 18 can then be disconnected from the hose bib and the toy water gun system shown in FIG. 1 is ready for operation. The pressure in receptacle 12 can be at any value desired since the hose bib can be shut off at any time for reduced pressure in receptacle 12. However, for maximum effectiveness the flow will be allowed into receptacle 12 until the pressure of the water and trapped air is at a maximum which will be the same pressure as provided by the municipal water supply. In another embodiment shown in FIG. 2, ambient air is also trapped in the receptacle 24 with a small amount of air trapped in bladder 26. Fitting 34 is disconnected from fitting 32 whereby fitting 32 is attached to a flexible tube 38 having external threads 40 on one end and internal threads 42 on the other end. Both ends of flexible tube 38 will turn independent of flexible tube 38 to allow a simplified connection to a municipal water supply. The end 42 of flexible tube 32 is fitted to a hose bib supplying pressurized water from a municipal water supply. The pressurized water is allowed to flow past the on/off valve 31 into bladder 26 inside receptacle 24 containing trapped air. When the pressure in receptacle 24 equals the pressure of the municipal water supply (up to 90 psi), flow will stop, shut-off valve 31 is turned to the off position and the fitting 32 is disconnected from the flexible tube 38 by turning and unscrewing end 40. Fitting 32 is then connected to fitting 34 and the on/off valve 31 is turned to the on position. The toy water gun system described in FIG. 2 is ready for operation. As with the embodiment of FIG. 1, the hose bib valve can be shut off at any time for reduced pressure in receptacle 24. However, for maximum effectiveness the flow will be allowed until the pressure of the water in the bladder and trapped air is at a maximum which will be the same pressure as provided by the municipal water supply.

It is noted that the configuration as seen in FIG. 2 can operate successfully with or without bladder 26. While this configuration is not shown, the manner of charging the configuration in FIG. 2 will be the same as described herein whereby the pressurized water will compress the air inside the receptacle 24 as described by the operation of the configuration of FIG. 1.

The flexible bag 50 described in FIGS. 9, 10 and 11 will accept either the configuration of FIGS. 1 or 2. The flexible adjustable belt 54 and holster 60 allows the operator to efficiently operate the toy water gun systems described herein.

The material for the receptacle in both embodiments is a high strength thermoformed plastic. The tubing material is also high strength plastic. The on/off valve is hard plastic. The toy water gun is made from a thermo plastic material. The above material is used for the preferred embodiment, however, other materials can be used to provide the toy water gun system. All of the plastic material, tubing, fittings and valves will withstand a pressure of at least 100 psi.

Thus, it is apparent that there has been provided in accordance with the invention, a toy water gun system that fully satisfies the objectives, aims and advantages set forth above. While the invention has been described in conjunction with specific embodiments thereof, it is evident that many alternatives, modifications, and variations will be apparent to those skilled in the art in light of the aforegoing description. Accordingly, it is intended to embrace all such alternatives, modifications and variations that fall within the spirit and scope of the appended claims.

What is claimed is:

1. A toy water gun system designed to release pressurized water therefrom in an extended stream comprising:

a toy water gun containing a trigger mechanism, said trigger releasing said pressurized water from said toy water gun;

a receptacle for containing both pressurized water and pressurized air having a cylindrical body, said cylindrical body having a circular neck on one end of said cylindrical body;

a source of water under pressure, said source of water under pressure being furnished by a municipal water supply;

a hose bib having external threads and associated therewith an on and off valve, said hose bib attached to a pipe which is further connected to said municipal water supply;

means for fluid flow from inside said receptacle to said toy water gun comprising a first flexible tubing, said first flexible tubing having a first end and a second end, said first end being connected and extending into said toy water gun, said second end terminating inside on the bottom of said cylindrical body;

means for fluid flow from said source of water under pressure to said receptacle comprising a second flexible tubing, said second flexible tubing having a first end and a second end, said first end connected to said receptacle and second end having means to connect to said hose bib;

a one way valve means for filling said receptacle with pressurized water from said source of water under pressure associated with said second flexible tubing and; wherein said pressurized water entering said receptacle also pressurizes an air space contiguous to a space for accommodating said pressurized water in said receptacle, said pressurized air space in said receptacle becoming equal in pressure to the pressure of said water flowing from said municipal water supply;

a flexible bag for containing said receptacle therein;

an adjustable flexible belt worn by an operator;

means for mounting said flexible bag on said belt;

means for mounting said toy water gun on said belt.

2. A toy water gun system as described in claim 1 wherein said one way valve means is a spring biased valve located on said circular neck of said cylindrical body that allows water from said source of water under pressure to flow into said receptacle whereby said flow from said municipal water supply when released from said hose bib, having an on/off valve, allows said receptacle to be filled with said pressurized water and simultaneously pressurizing said air space inside said receptacle.

3. A toy water gun system as described in claim 1 wherein said means for fluid flow from said source of water under pressure to said receptacle is removably connectable by said second flexible tubing second end, said second flexible tubing second end means for connecting having a rotating connector with internal threads, said internal threads matching said external threads on said hose bib.

4. A toy water gun system as described in claim 1 wherein said trigger mechanism in said water gun in spring biased.

5. A toy water gun system as described in claim 1 wherein said receptacle and said flexible tubing is made from a suitable high strength plastic.

6. A toy water gun system as described in claim 5 wherein said plastic receptacle and said plastic flexible tubing can withstand 100 pounds per square inch (p.s.i.) without failing.

7. A toy water gun system as described in claim 1 wherein said means for mounting said flexible bag is an attachment on said adjustable belt worn by an operator.

8. A toy water gun as described in claim 1 wherein means for mounting said toy water gun is a holster attached to said adjustable belt worn by an operator.

9. A toy water gun system designed to release pressurized water therefrom in an extended stream comprising a toy water gun containing a valve activated by a trigger mechanism, said valve releasing said pressurized water from said toy water gun system;

a receptacle for containing pressurized air having a cylindrical body, said cylindrical body having a circular neck on one end of said cylindrical body, said cylindrical body containing a bladder, said bladder being a flexible nonporous membrane, said bladder containing both pressurized water and pressurized air, said bladder being surrounded by said pressurized air inside said receptacle;

a source of water under pressure, said source of water under pressure being furnished by a municipal water supply;

a hose bib, having external threads and associated therewith; an on and off valve, said hose bib attached to a pipe which is further connected to said municipal water supply;

means for fluid flow from said source of water under pressure to a valve means comprising a first flexible tubing, said first flexible tubing having a first end and a second end, said first end being connected to said hose bib, said second end connected to said valve means;

means for fluid flow from said valve means to said receptacle comprising a second flexible tubing, said second flexible tubing having a first end and a second end, said first end being connected to said valve means and second end connected to said bladder inside said receptacle;

means for fluid flow from said valve means to said toy water gun comprising a third flexible tubing, said third flexible tubing having a first end and a second end, said first end connected to said valve means and said second end connected to and extending into said toy water gun;

an adjustable belt worn by an operator;

a flexible bag for containing said receptacle therein;

means for mounting said flexible bag on said belt;

means for mounting said toy water gun on said belt,

10. A toy water gun system as described in claim 9 wherein said valve means is an on and off valve for filling said bladder with pressurized water from said source of water under pressure associated with said second flexible tubing, and, wherein said pressurized water also pressurizes an air space inside said bladder and simultaneously pressurizes an air space outside said bladder and within said receptacle.

11. A toy water gun system as described in claim 9 wherein said valve means is also an on and off valve for admitting pressurized water from said bladder to said water gun.

12. A toy water gun system as described in claim 9 wherein said receptacle is made from a suitable high strength plastic capable of withstanding a pressure of 100 pounds per square inch (p.s.i) without failing.

13. A toy water gun system as described in claim 9 wherein said flexible tubing is made from a suitable high strength plastic capable of withstanding a pressure of 100 pounds per square inch (p.s.i.) without failing.

14. A toy water gun system as described in claim 9 wherein said means for mounting said flexible bag is an attachment on said adjustable belt worn by an operator.

15. A toy water gun system as described in claim 9 wherein said means for mounting said toy water gun is a holster attached to an adjustable belt worn by an operator.

16. A method of releasing pressurized water from a toy water gun system in an extended stream comprising:

providing a toy water gun having a trigger mechanism;

providing a receptacle containing air with a one way spring biased valve attached thereto;

charging said receptacle through said valve with pressurized water from a source of water under pressure furnished by a municipal water supply through a hose bib having external threads when said water is released by a valve on said hose bib from said municipal water supply through fluid flow means to said one-way spring biased valve and further to said receptacle, said pressurized water compressing said air in said receptacle until said pressure inside said receptacle is equal to the pressure of said municipal water supply, wherein said fluid flow means comprises a first flexible tubing, said first flexible tubing having a first end and a second end, said first end having a rotating connector having internal threads to be connected to said external threads of said hose bib, said second end connected to said one way spring biased valve attached to said receptacle;

providing fluid flow means from said receptacle to said toy water gun, said fluid flow means comprising a second flexible tubing, said second flexible tubing having a first end and a second end, said first end connected to a tube extending into said receptacle, said second end extending into said toy water gun;

proving an adjustable belt worn by an operator;

providing a flexible bag for containing said receptacle;

providing a holster to hold said water gun;

mounting said flexible bag containing said receptacle on said adjustable belt worn by an operator;

attaching said holster to said adjustable belt worn by an operator:

providing release of water from said toy water gun when activated by said trigger mechanism, said trigger being spring biased whereby activating said trigger mechanism allows pressurized water to be released from said toy water gun.

17. A method of releasing pressurized water from a toy water gun system as described in claim 16 wherein said receptacle containing both pressurized water and pressurized air has a cylindrical body, said cylindrical body having a circular neck on one end of said cylindrical body, said circular body being made from a suitable plastic and being capable of withstanding a pressure of 100 pounds per square inch (p.s.i.).

18. A method of releasing pressuring water from a toy water gun system as described in claim 16 wherein said first flexible tubing and said second flexible tubing being formed from a suitable plastic and being capable of withstanding a pressure of 100 pounds per square inch (p.s.i.).

* * * * *